US011027170B2

(12) United States Patent
Carr et al.

(10) Patent No.: US 11,027,170 B2
(45) Date of Patent: Jun. 8, 2021

(54) MULTI-PLANAR ROTATIONAL PLATFORM AND SUSPENSION EXERCISE DEVICE

(71) Applicant: International Business Alliance Management, Inc., Sherman Oaks, CA (US)

(72) Inventors: Olden Carr, Irvine, CA (US); Dah Kong Chen, Sherman Oaks, CA (US); Zhixiang Huang, Huizhou (CN)

(73) Assignee: International Business Alliance Management, Inc., Sherman Oaks, CA (US)

( * ) Notice: Subject to any disclaimer, the term of this patent is extended or adjusted under 35 U.S.C. 154(b) by 0 days.

(21) Appl. No.: 15/834,475

(22) Filed: Dec. 7, 2017

(65) Prior Publication Data

US 2019/0175983 A1 Jun. 13, 2019

(51) Int. Cl.

| | |
|---|---|
| ***A63B 22/18*** | (2006.01) |
| ***A63B 21/04*** | (2006.01) |
| ***A63B 21/055*** | (2006.01) |
| ***A63B 22/00*** | (2006.01) |

(52) U.S. Cl.

CPC ..... *A63B 22/18* (2013.01); *A63B 21/04* (2013.01); *A63B 21/0557* (2013.01); *A63B 21/0552* (2013.01); *A63B 22/0046* (2013.01); *A63B 2022/0033* (2013.01); *A63B 2209/00* (2013.01)

(58) Field of Classification Search

CPC ..... A63B 22/18; A63B 22/0046; A63B 2022/0033

See application file for complete search history.

(56) References Cited

U.S. PATENT DOCUMENTS

| | | | | |
|---|---|---|---|---|
| 3,352,559 A * | 11/1967 | Larsen | A63B 69/3667 | 473/269 |
| 4,191,371 A * | 3/1980 | Armer, Jr. | A63B 21/0004 | 482/146 |
| 5,613,690 A * | 3/1997 | McShane | A63B 22/18 | 273/449 |
| 5,683,337 A * | 11/1997 | Zetocha | A63B 22/14 | 482/146 |
| 5,879,276 A * | 3/1999 | Miller | A63B 22/14 | 482/131 |
| 5,919,150 A * | 7/1999 | Zanakis | A61B 5/1036 | 600/595 |
| 6,176,817 B1 | 1/2001 | Carey et al. | | |
| 6,419,586 B1 * | 7/2002 | Chiu | A63B 22/18 | 472/135 |

(Continued)

*Primary Examiner* — Andrew S Lo
(74) *Attorney, Agent, or Firm* — Kelly & Kelley, LLP

(57) ABSTRACT

An exercise device including a base plate having a generally circular wall extending upwardly therefrom to define a base body having an interior cavity. Spaced apart roller assemblies are disposed within an interior of the base body. A generally convex dome of a motion platform assembly is at least partially disposable within the base body so as to contact the roller assemblies. The motion platform assembly slides, tilts or rotates as force is applied to an upper support platform. A lip of the motion platform assembly may contact a rim of the wall to limit a range of motion of the motion platform assembly. One or more elastic cords extending between the base body and the motion platform assembly provide resistance to motion of the platform assembly.

16 Claims, 7 Drawing Sheets

(56) References Cited

U.S. PATENT DOCUMENTS 6,428,451 B1 * 8/2002 Hall ..... A63B 22/18 482/146
6,740,008 B1 * 5/2004 Ho ..... A63B 21/0004 482/123
D538,358 S * 3/2007 Glier ..... A63B 69/06 D21/662
7,621,861 B1 * 11/2009 Kalember ..... A63B 22/14 482/146
8,529,418 B2 * 9/2013 Stewart ..... A63B 21/015 273/449
2002/0077231 A1 * 6/2002 Dalebout ..... A63B 22/18 482/146
2004/0142801 A1 * 7/2004 Lin ..... A63B 21/0004 482/142
2004/0142802 A1 * 7/2004 Greenspan ..... A61H 1/0237 482/146
2007/0027009 A1 * 2/2007 Arnold ..... A63B 21/005 482/146
2007/0207906 A1 * 9/2007 Blaum ..... A63B 22/18 482/146
2007/0298947 A1 * 12/2007 Eksteen ..... A63B 21/0004 482/141
2008/0039304 A1 * 2/2008 Mattox ..... A63B 21/0004 482/130
2008/0194392 A1 * 8/2008 Langer ..... A63B 21/0004 482/146
2009/0215597 A1 * 8/2009 Fernandez ..... A63B 22/18 482/146
2010/0087300 A1 * 4/2010 Pratson ..... A63B 21/0552 482/142
2010/0167887 A1 * 7/2010 Berry ..... A63B 22/18 482/147
2011/0111935 A1 * 5/2011 Cole ..... A63B 21/0552 482/142
2011/0143896 A1 * 6/2011 Senegal ..... A63B 22/18 482/139
2013/0095982 A1 * 4/2013 Chen ..... A63B 21/025 482/71
2013/0260971 A1 * 10/2013 Cole ..... A63B 21/0552 482/142
2014/0087927 A1 * 3/2014 Richard ..... A63B 71/0036 482/123
2014/0302974 A1 * 10/2014 Cole ..... A63B 21/0552 482/142
2014/0309092 A1 * 10/2014 De Michele ..... A63B 26/00 482/142
2015/0196798 A1 * 7/2015 Baschnagel ..... A63B 21/0004 482/140
2015/0238793 A1 * 8/2015 Kramer ..... A63C 17/0093 482/142
2016/0199699 A1 * 7/2016 Klassen ..... A63B 22/16 482/146
2017/0001069 A1 * 1/2017 Sassano ..... A63B 23/02
2017/0021220 A1 * 1/2017 Pagano ..... A63B 22/18
2017/0165552 A1 * 6/2017 Martin ..... A63B 69/06
2017/0303691 A1 * 10/2017 Jen ..... A47C 9/002
2018/0193693 A1 * 7/2018 Youm ..... A63B 26/003

* cited by examiner

MULTI-PLANAR ROTATIONAL PLATFORM AND SUSPENSION EXERCISE DEVICE

FIELD OF THE INVENTION

The present invention generally relates to exercise devices. More particularly, the present invention relates to a multi-planar rotational platform and suspension device enabling improvement of balance and strength.

BACKGROUND OF THE INVENTION

The physical benefits of compact rotational exercise and therapy devices designed for individual use in the home or office are well known. In general, the structure and function of most rotational exercise and therapy devices involve platforms having either horizontal rotation about an axis or a vertical rotation about an axis. Many such rotational exercise and therapy devices have a platform that rotates horizontally and not vertically or a platform that provides vertical rotation from side to side but does not provide for horizontal rotation. In addition, in some cases, the platform must be stopped in its rotation and then started again in the opposite direction. This does not allow the operator to achieve maximum therapy or strength or balance for the selected joint musculature.

Some of the rotational exercise and therapy devices require motorization. However, such motorized mechanisms make the device very expensive to own and operate. Such devices can also be mechanically complicated with many parts which could require frequent repair or mandate numerous adjustments. It could require skilled maintenance and would be unaffordable for many people requiring therapy or desiring to increase their strength or balance and wishing to have a versatile low-cost exercise device.

Many of such rotational exercise and therapy devices permit a near unlimited range of motion, which can present a safety hazard, particularly when the operator is initially mounting the device or if the operator is merely beginning to use the device and has not developed his or her balance and strength to an appropriate level.

Moreover, many of the preexisting rotational exercise and therapy devices are freely rotating or provide such rotation, such as by means of a motor or the like, and do not provide any resistive forces. The lack of resistive forces limits the ability of the operator to strengthen the desired muscles and joints.

Accordingly, there is a continuing need for an improved rotational exercise and therapy device which will be inexpensive to manufacture, responds to changes in the operator's center of gravity, and also allows for selective resistance to free movement while also being safe to use. The present invention fulfills these needs and provides other related advantages.

SUMMARY OF THE INVENTION

The present invention resides in a multi-planar rotational platform and suspension exercise and therapy device. The exercise device generally comprises a base body comprising a base plate and a generally circular wall extending upwardly from the base plate to define an interior cavity of the base body. A plurality of spaced apart roller assemblies are disposed within the interior cavity of the base body.

A motion platform assembly is partially disposable within the interior cavity of the base body. The motion platform assembly comprises a generally convex dome at a lower portion thereof and a support platform at an upper surface thereof. The dome extends into the interior cavity of the base body so as to contact the plurality of spaced apart roller assemblies and permit the motion platform assembly to tilt or rotate as force is applied to the support platform.

Typically, there are at least three spaced apart roller assemblies that are disposed within the base body. The roller assemblies each comprise a roller at least partially disposed within a roller housing so as to freely rotate therein.

A lip extends from the motion platform assembly that limits the range of motion of the motion platform, such as contacting a rim of the wall of the base body as the motion platform assembly is tilted or rotated sufficiently to bring the lip into contact with the rim of the wall. The rim of the wall may be comprised of a sound dampening material. Alternatively, or additionally, a cover may be attached to the rim comprised of a sound dampening material.

At least one elastic cord may extend between the base body and the motion platform assembly. A first elastic cord attachment bracket is disposed on an outer surface of the wall of the base body for removably receiving a first end of the elastic cord. A second elastic cord attachment bracket is associated with the motion platform assembly for removably receiving a second end of the elastic cord. The at least one elastic cord provides resistance to the tilting or rotation of the motion platform assembly relative to the base body.

A hand rail may be associated with the base body for the user to safely grasp during operation of the device.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in an exercise device, generally referred to by the reference number 10. The exercise device 10 of the present invention is designed to provide increased safety during the mounting onto the device 10, while exercising, and dismounting from the device 10. Moreover, as will be more fully explained herein, the exercise device of the present invention provides resistive forces to strengthen the desired muscles and joints of the user while also increasing safety of the use of the device. The exercise device 10 of the present invention also provides other related advantages which will become apparent from the following detailed description.

Figure 1:
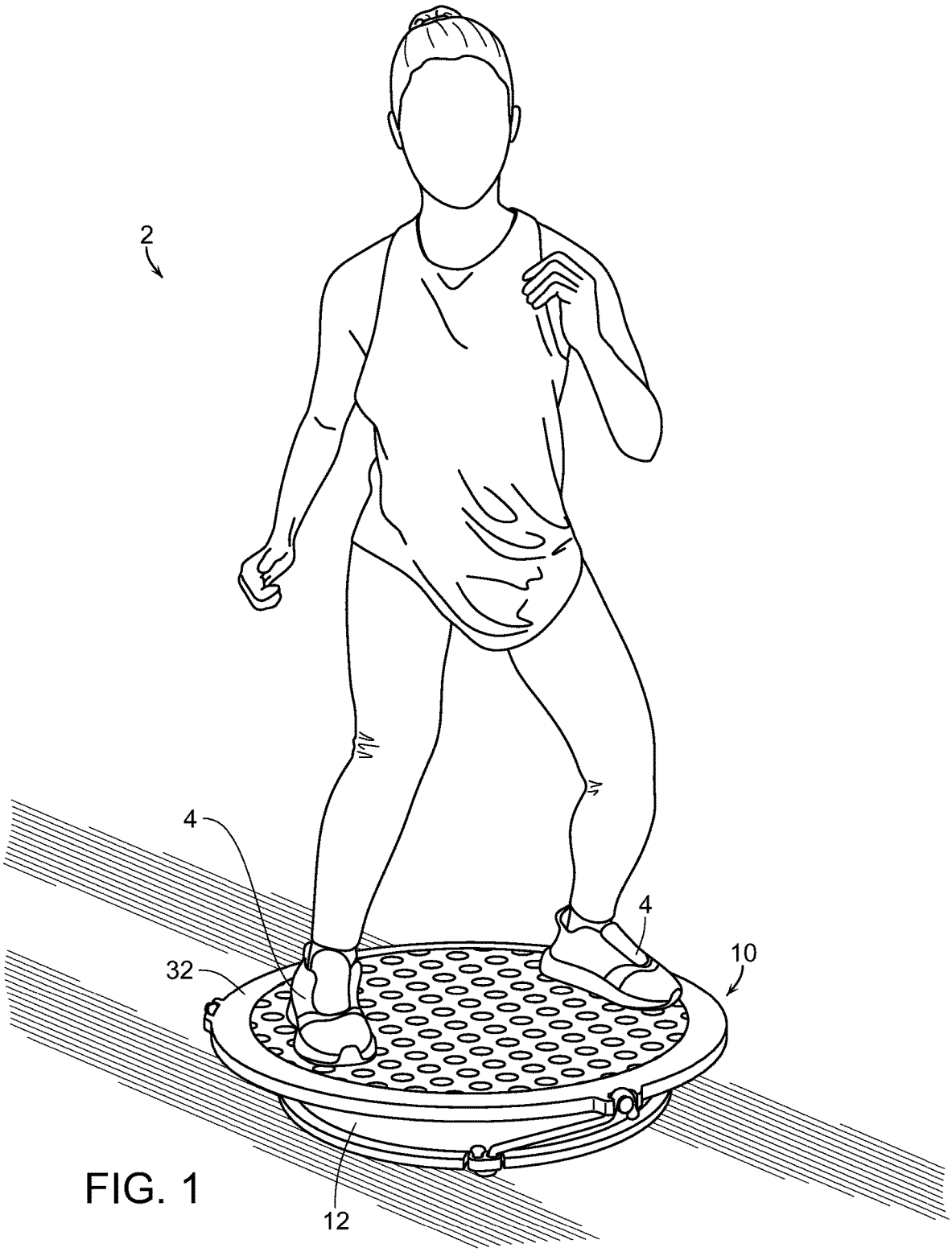
FIG. 1 is an environmental perspective view of an individual utilizing an exercise device embodying the present invention.

With reference to FIG. 1, an exercise device 10 embodying the present invention is shown being utilized by a user 2. In accordance with the present invention, as the user shifts his or her weight while on the exercise device 10, such as shifting the weight from one foot to another foot 4, a portion of the exercise device 10 pivots or tilts with respect to the other portion thereof, which serves to increase the user's balance and strength as the user operates the device. It will be understood by those skilled in the art that the exercise device 10 of the present invention can also be used in manners other than standing on the exercise device 10. For example, the user may be able to perform exercises while having his or her hands on top of the device 10 while his or her feet are on a supporting floor surface, having the user's feet 4 on an upper portion of the device 10 as a portion of the user's body is on the supporting floor surface, etc.

Figure 2:
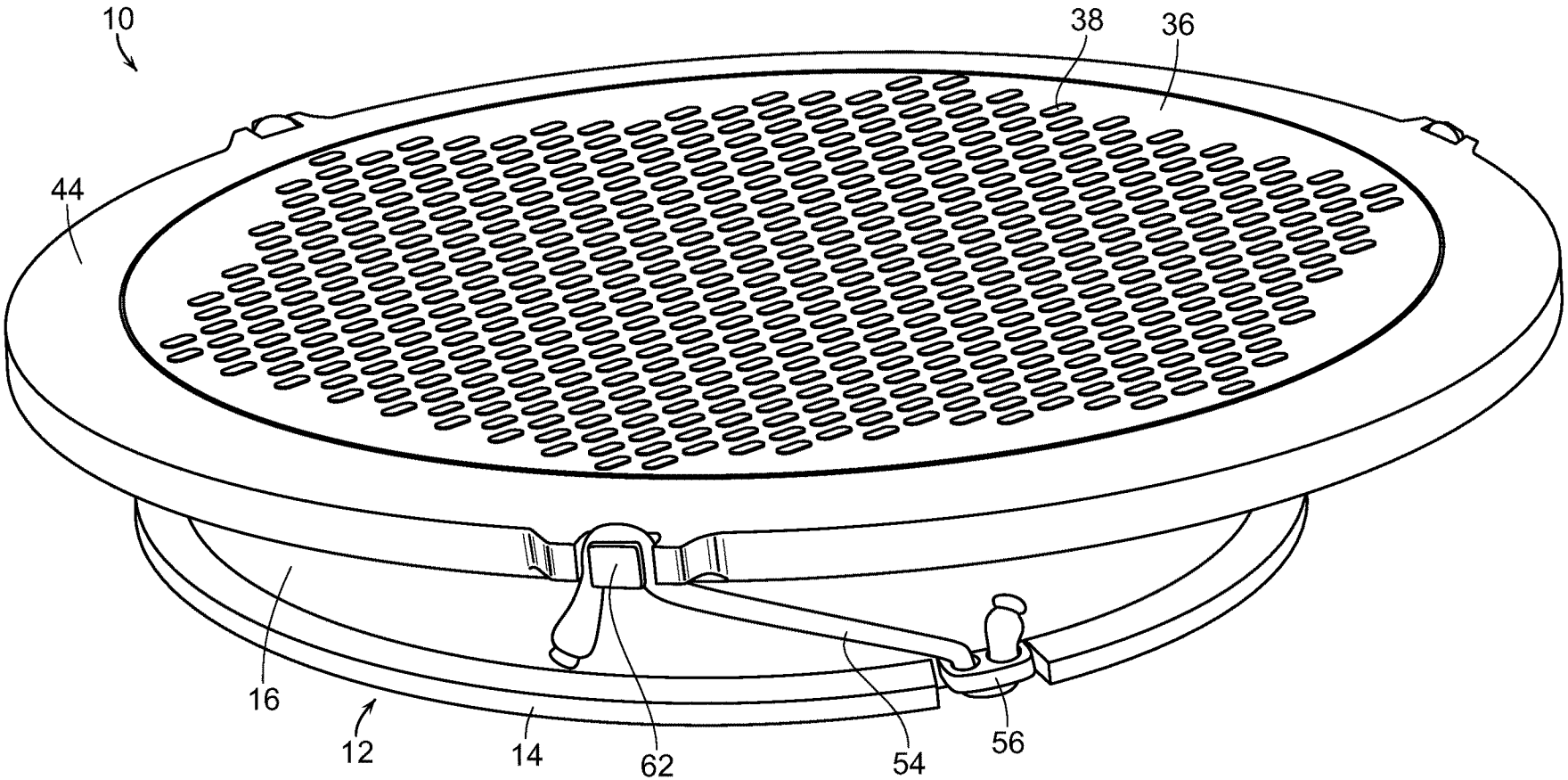
FIG. 2 is a side perspective view of an exercise device embodying the present invention.
Figure 3:
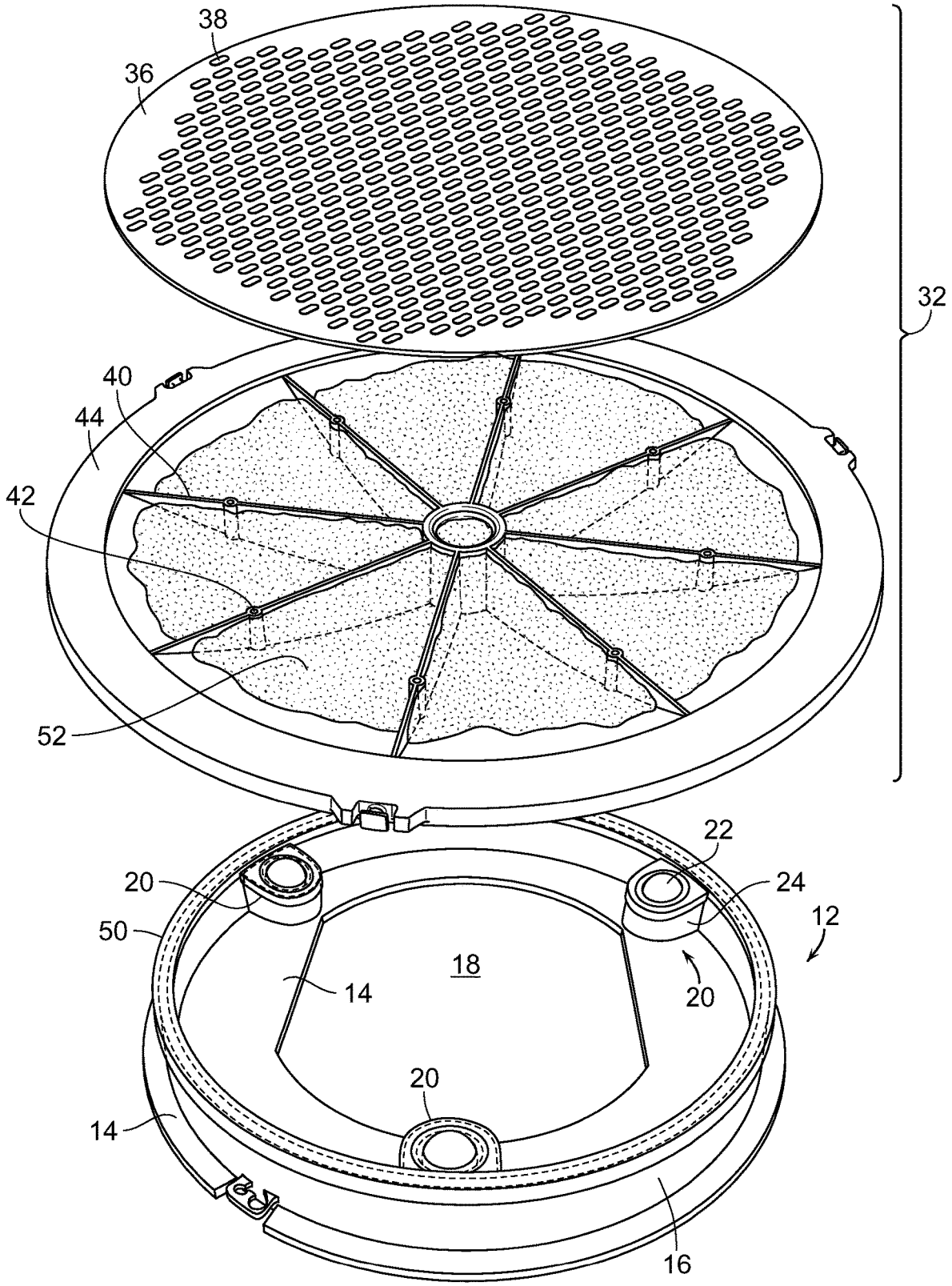
FIG. 3 is an exploded perspective view illustrating various components of the exercise device of the present invention.
Figure 4:
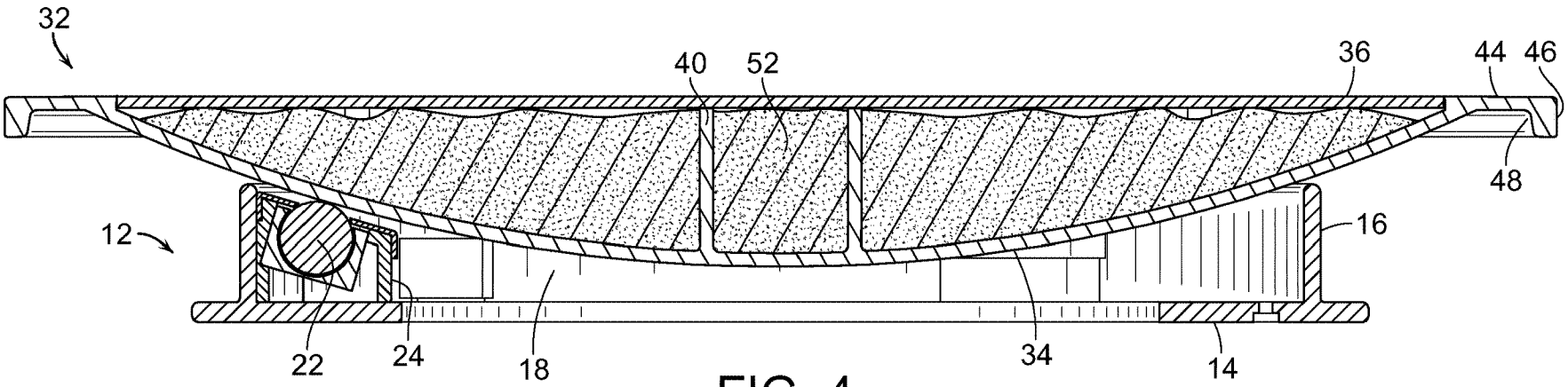
FIG. 4 is a cross-sectional view of an exercise device of the present invention.

With reference now to FIGS. 2-4, the exercise device 10 of the present invention is generally comprised of a base body 12 having a base plate 14. The base plate 14 is typically planar so as to be placed on a supporting surface, such as a floor or the like. A wall 16 extends upwardly from the base plate 14 so as to define an interior cavity 18 of the base body 12. The wall 16 may be circular in shape, as illustrated. The wall 16 is typically at least several inches in height so as to provide a needed depth of the interior cavity 18.

As illustrated in FIGS. 3 and 4, a plurality of roller assemblies 20 are disposed within the interior cavity 18 of the base body 12. Preferably, there are at least three spaced apart roller assemblies 20 which are disposed within the base body 12. The roller assemblies 20 are comprised of a roller 22 disposed within a roller housing 24 in such a manner that the roller 22 can freely rotate within the roller housing 24. Typically, the roller 22 is generally spherical in shape so as to roll and rotate in many different directions and along different axes so as not to limit the movement imparted by the user 2 when utilizing the exercise device 10.

Figure 5:
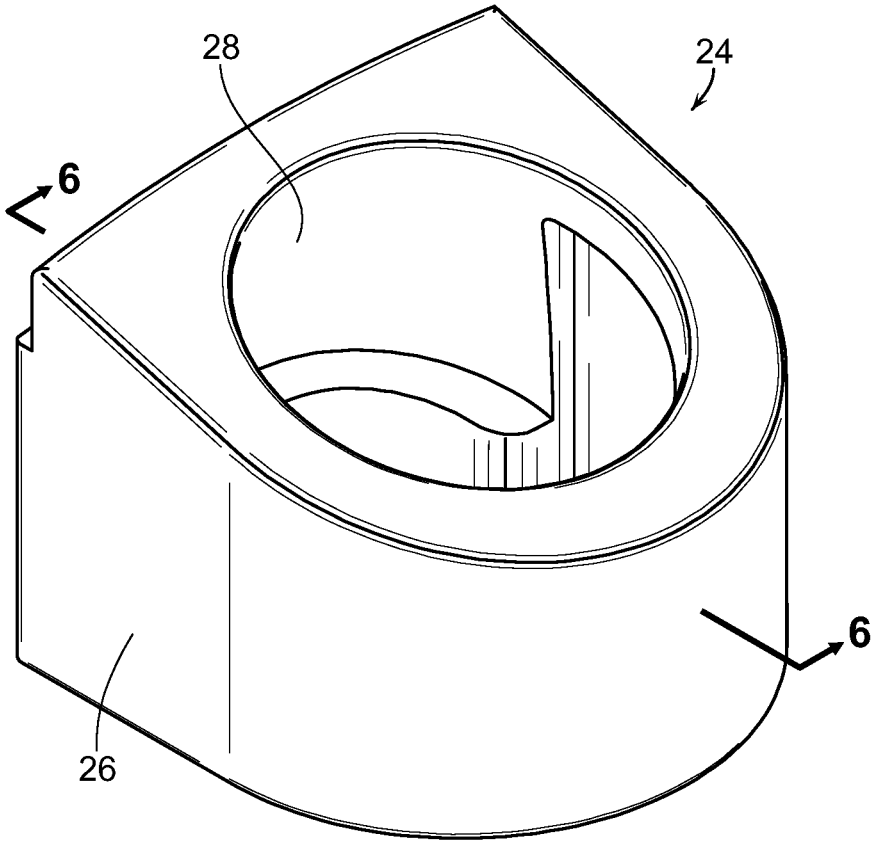
FIG. 5 is a perspective view of a roller housing used in connection with the present invention.
Figure 6:
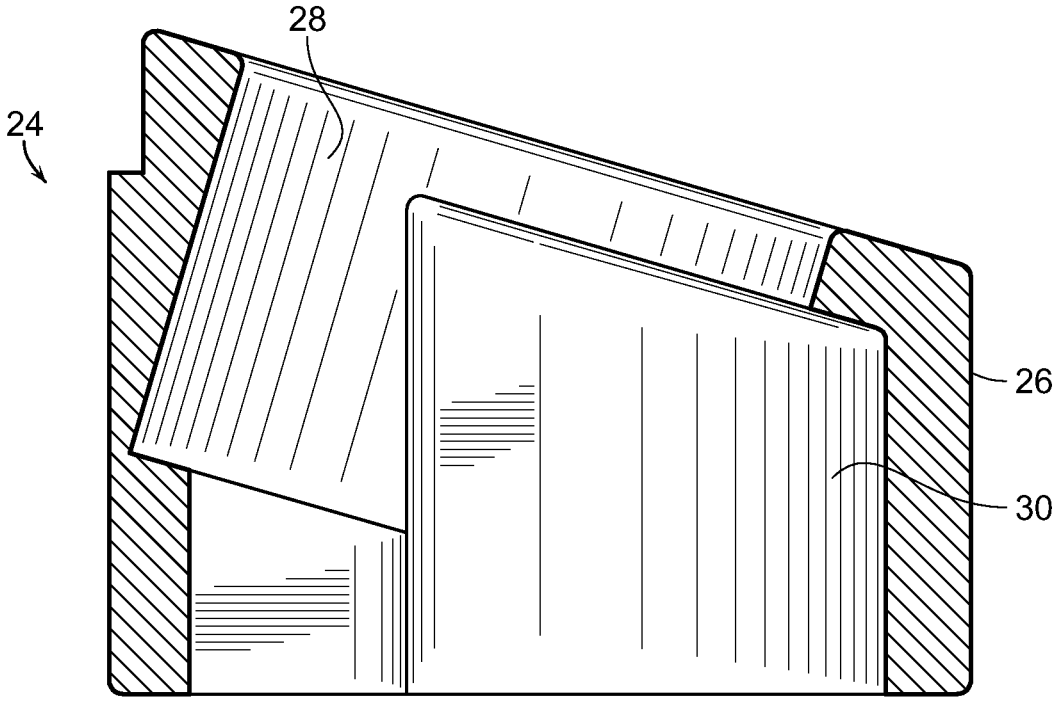
FIG. 6 is a cross-sectional view taken generally along line 6-6 of FIG. 5.

The roller housing 24 may be formed integrally with the base body 12, or attached thereto, such as by providing mating apertures between the roller housing 24 and base body 12 so as to removably attach the roller housing 24 to the base body 12. Preferably, the roller housings 24 are generally equidistant from one another. As illustrated in FIGS. 5 and 6, the roller housing 24 is comprised of a wall 26 which defines interior cavities 28 and 30 into which the roller 22 can be inserted. It will be seen that interior cavity 28 is configured so as to direct the rolling ball 22 at an inwardly facing angle to the central axis of the base body 12. This configuration and positioning is much more effective than having the rollers 22 positioned within a generally vertical cavity. It is contemplated by the present invention that at least a portion of interior cavity 28 and/or 30 be filled with a cushioning and/or noise dampening material. Such could be, for example, a foam fill material or the like.

With reference again to FIGS. 3 and 4, a motion platform assembly is at least partially disposable within the interior cavity 18 of the base body 12, as illustrated in FIG. 4. The motion platform assembly 32 comprises a generally convex dome 34 at a lower portion thereof and a support platform 36 at an upper surface thereof. As can be seen in FIG. 4, the dome 34 extends into the interior cavity 18 of the base body 12 so as to contact the rollers 22 of the roller assemblies 20. As force is supplied to the support platform 36 the motion platform assembly will tilt or rotate as the outer surface of the dome 34 causes the rollers 22 to rotate and spin. Preferably, the outer surface of the dome 34 is generally smooth so as not to inhibit rotation of the rollers 22 as force is applied thereto.

The support platform 36 is attached to the dome 34 so as to present a generally planar support surface for the user. The upper surface of the support platform 36 may include a grip material 38 or have indentations, scores or other textured surface so as to create grip 38. The support platform 36 may be attached to the dome 34 in a variety of manners. In the illustrated embodiment, the support platform 36 is attached to the dome 34 by attaching the support platform 36 to a plurality of ribs 40 which are disposed within the interior of the dome 34, such as for providing strength and support to the dome as well as the support platform 36. This may be done by means of inserting fasteners through the support platform 36 and into tubular receptacles 42 associated with the ribs 40. It will be understood, however, that the support platform 36 could also be attached to an outer circumference of the dome 34 or by other means.

A lip 44 extends outwardly from the motion platform assembly 32 around a circumference thereof. The lip 44 serves to limit the tilting or rotation range of movement of the motion platform assembly 32. This may be, for example, by means of the lip 44 coming into contact with an upper edge of the wall 16 of the base body 12. In the illustrated embodiment, the lip 44 includes a downwardly directed shoulder 46 defining a circumferential ring or groove 48. The upper edge of the wall 16 will come into contact with the circular groove or ring 48, and the shoulder 46 will prevent further motion of the support platform 36 as it comes into contact with the wall 16 of the base body 12.

In order to reduce noise, vibration or other forces created by the impact between the lip 44 of the motion platform assembly 32 and the wall 16 of the base 12, at least a portion of the wall 16 may be comprised of a sound dampening and/or vibration dampening material. Alternatively, as illustrated in FIG. 3, a cover 50 may be attached to the upper rim of the wall 16 that is comprised of a sound dampening material or cushion material or the like to serve these purposes. Furthermore, vibration and/or sound dampening material 52, such as a foam fill, may at least partially fill the interior cavity of the dome 34 to further lessen such vibrational and sound forces. Such fill material 52 can also serve to strengthen the structure of the motion platform assembly 32.

In use, a user may position a portion of his or her body or his or her entire body upon the support platform 36 of the motion platform assembly 32 which has the dome 34 thereof disposed within the interior cavity 18 of the base body 12. As the user 2 shifts his or her weight, this causes forces to be applied to the support platform 36, causing the motion platform assembly 32 to pivot, tilt and/or rotate as the smooth outer surface of the dome 34 contacts the rollers 22 of the roller assemblies 20. The user increases his or her balance and/or strength by attempting to control the degree of movement of the motion platform assembly 32 and/or maintaining his or her balance on the support platform 36 as the motion platform assembly 32 is moved or to prevent such movement. It will be understood that the user 2 can move the motion support platform assembly 32 along horizontal directions, rotate the motion platform assembly, or tilt or pivot the motion platform assembly 32 with respect to the base body 12. Such pivotal or tilting motion can be restricted as the outer circumferential lip 44 contacts an upper rim of the wall 16 or the cover 50 attached thereto. This provides a degree of safety as opposed to a limitless range of motion between the base body 12 and motion platform assembly 32.

With reference again to FIG. 2, one or more elastic cords 54 may extend between the base body 12 and the motion platform assembly 32. The elastic cord 54 may be comprised of a tubular or solid material capable of stretching under tension force. These may be comprised of, for example, elastic material, bungie cords, or the like. Such elastic cords 54 provide resistance to the tilting or rotation motion of the motion platform assembly 32 relative to the base body 12. When the one or more elastic cords 54 are attached between the base body 12 and the motion platform assembly 32, they create resistance to the multi-dimensional motions of sliding, tilting and rotation of the motion platform assembly 32 relative to the base 12. The resistance of these motions of the motion platform assembly 32 requires that a sufficient enough load be placed upon the support platform 36 to move the motion platform assembly 32, and more particularly the dome 34 relative to the roller assemblies 20.

This creates a safer, quasi-stable support platform 36 when minimum load is placed upon the support platform 36, such as when mounting and dismounting from the motion platform assembly 32. Single or multiple elastic cords 54 can be attached between the base body 12 and the motion platform assembly 32 to increase or decrease the resistance. Different lengths of elastic cords 54 may also be selected to achieve this purpose, or the type of material of the elastic cord 54 can be altered by using different elastic cords 54 to also increase or decrease the resistive forces. The resistance of the elastic cords or bands 54 can be overcome by a load or force applied by the user's feet, hands, or other body surfaces, which reacts to minute motion platform assembly 32 via reaction, resulting in the user applying additional force or load to rotate, tilt, slide, or other cause other motion or movement of the motion platform assembly 32 relative to the base body 12, thus providing resistance and increasing the user's muscular and/or skeletal strength. Removal of the all elastic cords 54 immediately creates a less stable motion platform assembly 32, requiring advance skill and attention to load or force applied to the motion platform assembly 32 by the user.

Figure 7:
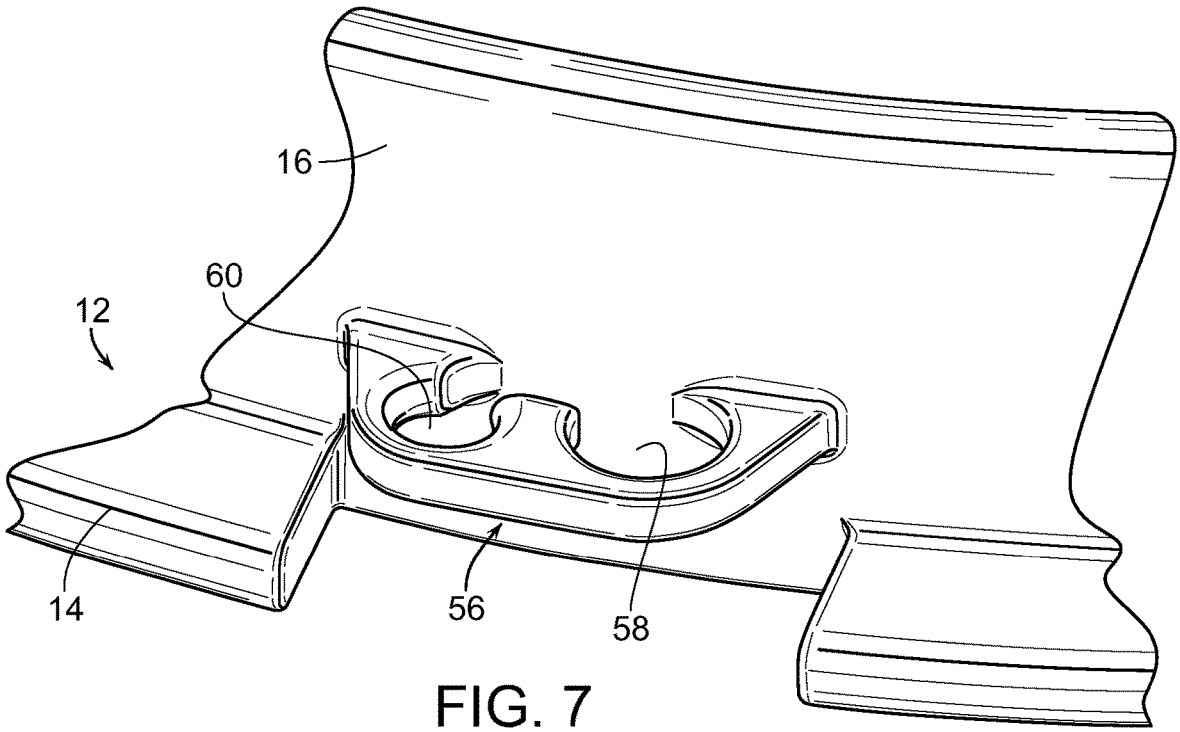
FIG. 7 is a partial perspective view of an elastic cord attachment bracket of a base body of the present invention.

With reference now to FIG. 7, the base body 12 includes an attachment bracket 56 for attaching a portion, typically an end, of the elastic cord 54 thereto. An end of the elastic cord may be enlarged in size, such as by forming a knot at an end thereof, so as to be held within the attachment bracket 56. For example, in the configuration illustrated in FIG. 7, the enlarged end may be larger than the diameter of the aperture 58, with a length of the band extending through aperture 60 and then extending to the elastic cord attachment bracket 62 of the motion platform assembly.

Figure 8:
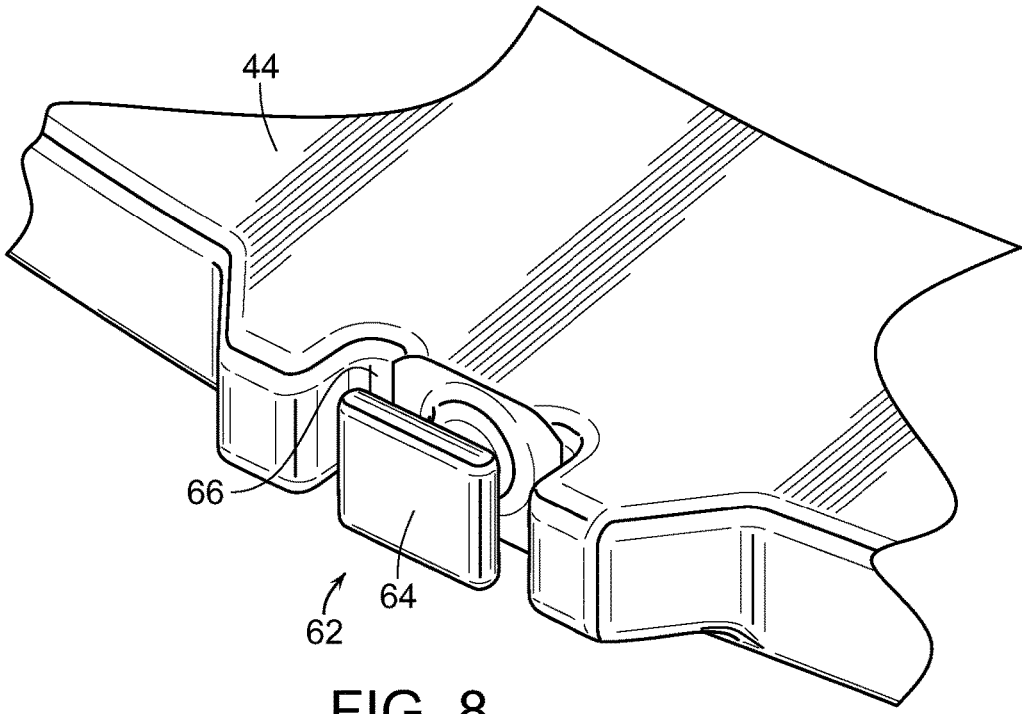
FIG. 8 is an elastic cord attachment bracket of a motion platform assembly.

FIG. 8 illustrates an exemplary elastic cord attachment bracket 62 which is integrally formed with or attached to the motion platform assembly 32. As illustrated, the bracket 62 is attached to an outer edge of lip 44. The bracket 62 may be comprised of a block 64 defining a passageway 66 surrounding an interior to the block 64 of a sufficiently large size so as to receive a length of the elastic cord 54 therein, but prevent an enlarged end of the elastic cord from passing therethrough. It will be appreciated that other configurations of such attachment brackets 56 and 62 could be utilized to achieve the purposes of the invention.

Preferably, there are a plurality of such attachment or locking brackets 56 and 62 in spaced relation along the base body 12 and the motion platform assembly 32 so that one or more elastic cords 54 can be attached therebetween and provide stability and resistance to motion. As illustrated, there are three pairs of attachment brackets 56 and 62 which are generally equidistantly separated from one another to permit up to three elastic cords 54 to extend between the base body 12 and the motion platform assembly 32.

Figure 9:
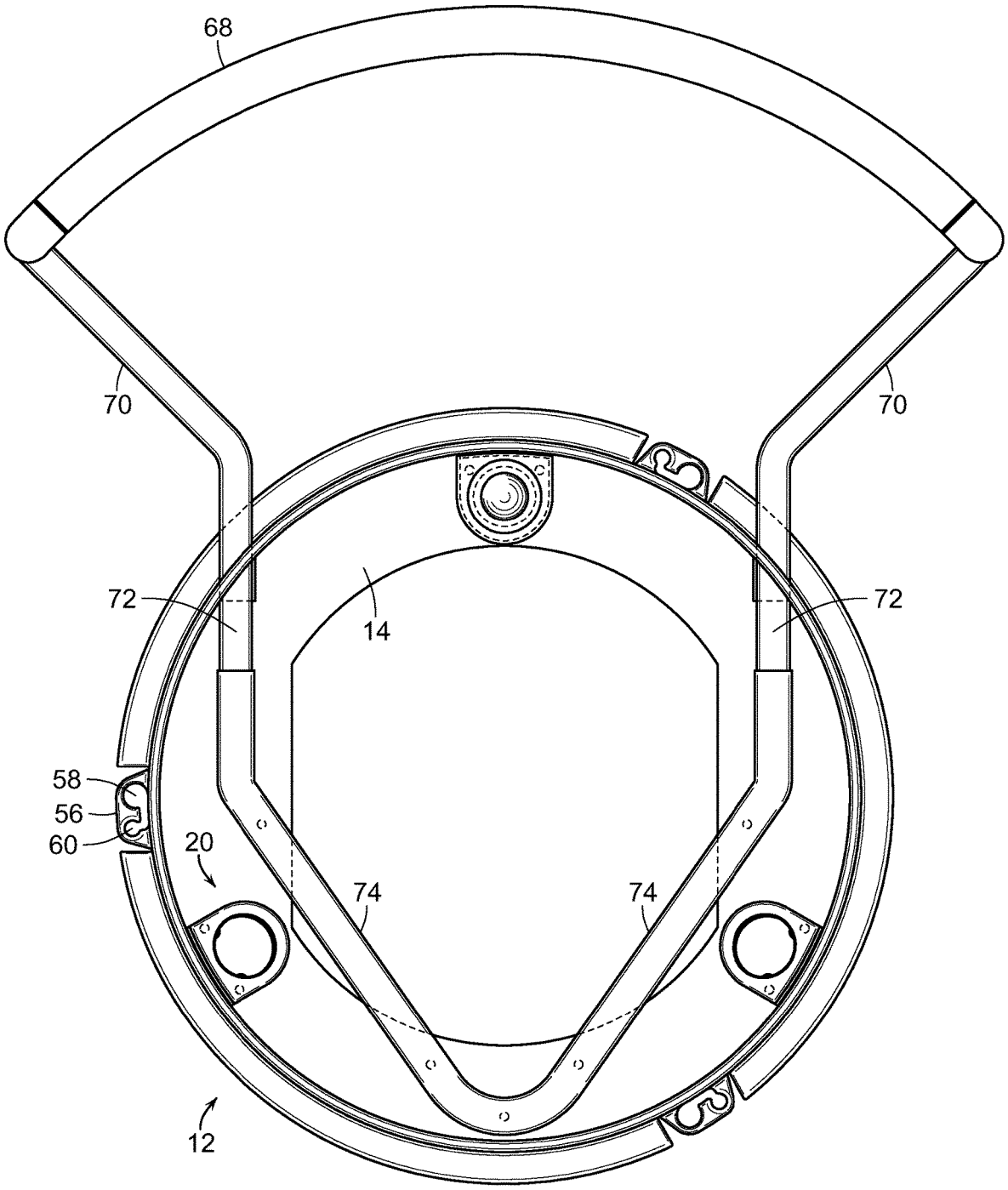
FIG. 9 is a top view of a base body of the exercise device of the present invention having a hand rail associated therewith in accordance with the present invention.

With reference now to FIG. 9, the present invention contemplates the incorporation of a handrail 68 that the user can grasp onto for stability and support when utilizing the exercise device 10. A handrail 68 is disposed several feet above the base body 12, such as between the waistline and chest of the user so that the user can easily grasp with at least one hand the handrail 68 to assist the user in maintaining his or her balance and moving the motion platform assembly 32 relative to the base body 12. Preferably, the handrail 68 is generally arcuate in configuration so as to provide space between the handrail 68 and the user and not impede the user's movements. One or more vertical tubes 70 are attached to or have formed at a lower end thereof base tubes 72 which are insertable into a "V-extension" which is attached to or otherwise associated with the base body 12, such as being attached to the base plate 14, as illustrated. It is contemplated that the handrail 68, and associated tubular structure, can be removably attached to the exercise device 10 as desired. Alternatively, it will be understood that the handrail 68 can be of a permanent attachment. The handrail 68 may be adjustable both in vertical height and/or extension towards or outward from the base body 12, such as by providing telescoping connections between the tubular segments 70-74.

Although several embodiments have been described in detail for purposes of illustration, various modifications may be made without departing from the scope and spirit of the invention. Accordingly, the invention is not to be limited, except as by the appended claims.

What is claimed is:

1. An exercise device, comprising:

a base body comprising a base plate and a generally circular wall extending upwardly from the base plate to define an interior cavity of the base body;

at least three spaced apart roller assemblies disposed within the interior cavity of the base body, each roller assembly comprising a spherical roller at least partially disposed within a roller housing so as to freely rotate therein; and a motion platform assembly partially disposable within the interior cavity of the base body, the motion platform assembly comprising a generally convex dome at a lower portion thereof and a support platform at an upper surface thereof;

wherein the dome extends into the interior cavity of the base body so as to contact the at least three spaced apart roller assemblies to allow the motion platform assembly to tilt, slide and rotate as force is applied to the support platform; and wherein a lip extending downwardly from a circumference of the motion platform assembly contacts an upper rim of the wall of the base body as the motion platform assembly is tilted or rotated sufficiently to bring the lip into contact with the upper rim of the wall.

2. The exercise device of claim 1, wherein the base body or motion platform assembly is comprised of a sound or vibration dampening material.

3. The exercise device of claim 1, including a cover attached to and substantially covering the rim, the cover being comprised of a sound dampening material.

4. The exercise device of claim 1, including a handrail associated with the base body.

5. The exercise device of claim 4, wherein the handrail is attached integrally with the base body.

6. The exercise device of claim 1, including at least one elastic cord extending between the base body and the motion platform assembly that provides resistance to the tilting or rotation of the motion platform assembly relative to the base body.

7. The exercise device of claim 6, including a first elastic cord attachment bracket disposed on an outer surface of the wall of the base body for removably receiving a first end of the elastic cord and a second elastic cord attachment bracket associated with the motion platform assembly for removably receiving a second end of the elastic cord.

8. An exercise device, comprising:

a base body comprising a base plate and a generally circular wall extending upwardly from the base plate to define an interior cavity of the base body;

a plurality of spaced apart roller assemblies disposed within the interior cavity of the base body;

a motion platform assembly partially disposable within the interior cavity of the base body, the motion platform assembly comprising a generally convex dome at a lower portion thereof and a support platform at an upper surface thereof;

at least one elastic cord extending between the base body and the motion platform assembly that provides resistance to the tilting or rotation of the motion platform assembly relative to the base body; and a first elastic cord attachment bracket disposed on an outer surface of the wall of the base body for removably receiving a first end of the at least one elastic cord and a second elastic cord attachment bracket associated with the motion platform assembly for removably receiving a second end of the at least one elastic cord;

wherein the dome extends into the interior cavity of the base body so as to contact the plurality of spaced apart roller assemblies and the motion platform assembly tilt or rotate as force is applied to the support platform.

9. The exercise device of claim 8 including a lip extending from the motion platform assembly so as to contact a rim of the wall of the base body as the motion platform assembly is tilted or rotated sufficiently to bring the lip into contact with the rim of the wall.

10. The exercise device of claim 9, wherein the rim of the wall is comprised of a sound dampening material.

11. The exercise device of claim 9, including a cover attached to and substantially covering the rim, the cover being comprised of a sound dampening material.

12. The exercise device of claim 8, including a handrail associated with the base body.

13. The exercise device of claim 8, wherein at least three spaced apart roller assemblies are disposed within the base body.

14. The exercise device of claim 8, wherein the roller assemblies each comprise a roller at least partially disposed within a roller housing so as to freely rotate therein.

15. An exercise device, comprising:

a base body comprising a base plate and a generally circular wall extending upwardly from the base plate to define an interior cavity of the base body;

at least three spaced apart roller assemblies disposed within the interior cavity of the base body, each roller assembly comprising a spherical roller at least partially disposed within a roller housing so as to freely rotate therein;

a motion platform assembly partially disposable within the interior cavity of the base body, the motion platform assembly comprising a generally convex dome at a lower portion thereof and a support platform at an upper surface thereof;

a lip extending from the motion platform assembly so as to contact a rim of the wall of the base body as the motion platform assembly is tilted or rotated sufficiently to bring the lip into contact with the rim of the wall; and a cover attached to and substantially covering the rim, the cover being comprised of a sound dampening material;

wherein the dome extends into the interior cavity of the base body so as to contact the at least three spaced apart roller assemblies to allow the motion platform assembly to tilt, slide and rotate as force is applied to the support platform.

16. An exercise device, comprising:

a base body comprising a base plate and a generally circular wall extending upwardly from the base plate to define an interior cavity of the base body;

at least three spaced apart roller assemblies disposed within the interior cavity of the base body, each roller assembly comprising a spherical roller at least partially disposed within a roller housing so as to freely rotate therein;

a motion platform assembly partially disposable within the interior cavity of the base body, the motion platform assembly comprising a generally convex dome at a lower portion thereof and a support platform at an upper surface thereof;

at least one elastic cord extending between the base body and the motion platform assembly that provides resistance to the tilting or rotation of the motion platform assembly relative to the base body; and a first elastic cord attachment bracket disposed on an outer surface of the wall of the base body for removably receiving a first end of the elastic cord and a second elastic cord attachment bracket associated with the motion platform assembly for removably receiving a second end of the elastic cord;

wherein the dome extends into the interior cavity of the base body so as to contact the at least three spaced apart roller assemblies to allow the motion platform assembly to tilt, slide and rotate as force is applied to the support platform.

* * * * *